United States Patent [19]

Scott et al.

[11] Patent Number: 4,874,682

[45] Date of Patent: Oct. 17, 1989

[54] ORGANIC PHOTOCONDUCTORS WITH REDUCED FATIGUE

[75] Inventors: John Campbell Scott, Los Gatos; Meredith D. Shattuck, Hollister, both of Calif.

[73] Assignee: International Business Machines Corporation, Armonk, N.Y.

[21] Appl. No.: 264,464

[22] Filed: Oct. 28, 1988

[51] Int. Cl.[4] ..... G03G 5/14

[52] U.S. Cl. ..... 430/59; 430/56; 430/58

[58] Field of Search ..... 430/59

[56] References Cited

U.S. PATENT DOCUMENTS

| | | | |
|---|---|---|---|
| 4,123,270 | 10/1978 | Heil et al. . | |
| 4,397,931 | 8/1983 | Limburg et al. | 430/59 |
| 4,450,218 | 5/1984 | Takei et al. | 430/59 |
| 4,490,452 | 12/1984 | Champ et al. | 430/58 |
| 4,559,287 | 12/1985 | McAneney et al. | 430/59 |
| 4,743,521 | 5/1988 | Hoffmann et al. | 430/59 X |

FOREIGN PATENT DOCUMENTS

| | | | |
|---|---|---|---|
| 58-2849 | 1/1983 | Japan | 430/59 |
| 58-184947 | 10/1983 | Japan | 430/59 |

OTHER PUBLICATIONS

"Reduction of Fatigue in Squarylium Patriculate Photoconductor by Electron-Transport Doping", IBM Technical Bulletin, vol. 24, No. 11B, Apr. 1982, p. 6194.

"Xerographic Photoconductor", IBM Technical Disclosure Bulletin, vol. 27, No. 10A, Mar. 1985, p. 6194.

"Xerographic Photoconductor", IBM Technical Disclosure Bulletin, vol. 27, No. 10A, Mar. 1985, p. 5605.

*Primary Examiner*—Roland E. Martin

*Attorney, Agent, or Firm*—Joseph G. Walsh

[57] ABSTRACT

Fatigue in organic photoconductors in which the charge transport layer is a source of acidic protons is reduced by including in the charge transport layer a small amount of a nonvolatile basic amine soluble in a common solvent with a charge transport material and the binder of the charge transport layer.

5 Claims, No Drawings

ORGANIC PHOTOCONDUCTORS WITH REDUCED FATIGUE

DESCRIPTION

TECHNICAL FIELD

The present invention is concerned with organic photoconductors in which fatigue is reduced by the addition of certain additives.

BACKGROUND ART

Many organic photoconductors are known to the prior art. In particular, many photoconductors are known which comprise a charge generation layer and a charge transport layer.

IBM TECHNICAL DISCLOSURE BULLETIN, Vol. 24, No. 11B, April 1982, page 6194, shows an organic photoconductor comprising a charge generator and a charge transport layer in which fatigue has been reduced by the addition of chloranil or trinitrofluorenone.

IBM TECHNICAL DISCLOSURE BULLETIN, Vol. 27. No. 10A, March 1985, page 5597, shows a charge transport layer with improved cycling fatigue to which diethylaminobenzaldehyde has been added. The publication, however, does not describe the type of binder to which the additive is added.

IBM TECHNICAL DISCLOSURE BULLETIN, Vol. 27, No. 10A, March 1985, page 5605, describes the addition of additives to a charge transport layer to reduce fatigue. The additives are dyes. The type of binder is not specified.

U.S. Pat. No. 4,123,270 shows the use of an amine as a solvent in the making of an organic photoconductor. The amine, however, is used only as a solvent and is volatile and does not remain in the final photoconductor.

U.S. Pat. No. 4,490,452 (see col. 1, line 37 and col. 2, line 11) shows the use of amines to solubilize the dye in an organic photoconductor and also to act as a cross-linker for the epoxy resin therein. These amines are volatile and furthermore, when they act as cross-linkers, they no longer remain as amines in the final composition.

DISCLOSURE OF THE INVENTION

The present invention is concerned with reducing fatigue in organic photoconductors. During the electrophotographic process, the photoconductor is subjected to a series of charge and illumination steps which often produce changes in the electric and optical properties of the photoconductor. These changes are called fatigue. Fatigue causes the operating characteristics to vary during the life of the photoconductors. This variance is obviously undesirable in actual commercial usage. The specific changes comprising fatigue include changes in dark charge acceptance and dark decay rate which can occur when the transport layer is exposed to light.

The present invention provides a solution to the problem of fatigue in charge transport layers wherein the charge transport layer is a source of acidic protons. Such protons may arise from any of two sources, the first from the binder, and the second from contaminants in either the binder or the charge generation material. According to the present invention, fatigue in such a charge generation layer is greatly reduced by the addition of a nonvolatile basic amine. The amine must be nonvolatile to remain in the final composition after the manufacturing process. The additive must be distributed uniformly throughout the charge transport layer. For this reason, it is necessary that the amine additive be soluble in a common solvent with the charge transport material and the binder so that all three may be dissolved in the solvent simultaneously to achieve uniform distribution.

The nonvolatile basic amine used in the present invention can be either monomeric or polymeric. Examples of preferred materials include 1,8-bis-(dimethylamino)napthalene which is, of course monomeric, and the polymeric material poly (vinyl pyridine). In general, the amount of amine additive is quite small, on the order from about 0.1% to 1% by weight of the charge transport layer. In most instances, an amount of about 0.25% is most preferred. In those instances where the amine additive has an oxidation potential more positive than that of the charge transport material layer, larger amounts of amine can be used.

The present invention is particularly useful in the case of the charge transport layer which has a polyester binder and p-diethylaminobenzaldehyde-1,1'-diphenylhydrazone (DEH) as the charge transport material. The invention, however, is also useful in other charge transport layers which act as a source of contaminating or accidental acidic protons.

When the present invention is used, the loss of dark voltage acceptance and increase in dark decay rates can be significantly improved. In accelerated fatigue tests, improvements in dark decay rates and dark voltage acceptance were observed in which the amount of improvement corresponded to the amount of amine additive. It must also be emphasized that photosensitivity is not significantly changed with the addition of the additive in the proper amount.

The following Examples are given solely for purposes of illustration, and are not to be considered limitations of the present invention, many variations of which will occur to those skilled in the art, without departing from the scope or spirit thereof.

EXAMPLE I

A layered organic photoreceptor was prepared in which the charge generation layer was comprised of a squaric acid methine dye as described in U.S. Pat. No. 3,824,099, and the charge transport layer was comprised of 40 parts p-diethylaminobenzaldehyde-1,1'diphenylhydrazone (DEH) in 60 parts polyester binder Vitel PE200. Vitel PE200, a registered trademark material available from Goodyear, had an acid number of 41.5 milliequivalents/gram and is used in this example as an extreme case of acidity in the binder.

A second photoreceptor was prepared in which the charge transport layer was comprised of 0.1% 1,8-bis(-dimethylamino)-naphthalene (Proton Sponge) in addition to 40% DEH and 59.9% Vitel PE200. Proton Sponge, a registered trademark material from Aldrich Chemical Co., is a strong base. The charge operation layer was comprised of a squaric acid methine dye as in the previous example.

The electrophotographic properties of both photoreceptors were measured before and after 1600 charge and expose cycles. It was found that the photoreceptor containing Proton Sponge in the charge transport layer lost 11% of its dark voltage acceptance capability after cycling while the photoreceptor without the Proton Sponge in the transport layer lost 18%. The dark decay rate of the cycled photoreceptor without Proton Sponge was also higher with only 17% of the voltage remaining on the photoreceptor after 14 seconds in the dark. The photoreceptor with Proton Sponge retained 43% during the same time period.

EXAMPLE II

A photoreceptor was prepared as in Example I except Ardel D-100 was used as the transport binder and 1-phenyl-3-(p-diethylaminostyryl)-5-(p-diethylamino phenyl)-pyrazoline, (DEASP), was used as the transport dopant. Ardel D-100, a polyarylate from Union Carbide, had an acid number of 44.6 milliequivalents/-gram. The transport dopant was added to the Ardel binder at a level of 40% as in the previous example.

A photoreceptor in which the transport layer was comprised of 2% poly(2-vinyl pyridine) (PVP), 40% DEASP and 58% Ardel was also prepared and the electrophotographic properties of the two photoreceptors were compared before and after cycling, in the same way as Example I.

The photoreceotor without PVP lost 35% of its dark voltage acceptance capability while the photoreceptor containing PVP lost 23% of the end of the same cycling period. The initial dark decay rate for the cycled photoreceptor without PVP was 69 V/sec; the dark decay rate was 40 V/sec for the photoreceptor containing PVP.

We claim:

1. An organic photoconductor comprising a charge generation layer and a charge transport layer which is a source of acidic protons, said charge transport layer comprising a charge transport material, a binder and distributed uniformly throughout said charge transport layer a nonvolatile basic amine selected from the group consisting of 1,8-bis-(dimethylamino)-naphthalene and poly(vinyl pyridine).

2. An organic photoconductor as claimed in claim 1 in which the amine is 1,8-bis-(dimethylamino)-naphthalene.

3. An organic photoconductor as claimed in claim 1 in which the amine is poly(vinyl pyridine).

4. An organic photoconductor as claimed in claim 1 wherein the binder is a polyester.

5. An organic photoconductor as claimed in claim 1 wherein the charge transport material is p-diethylaminobenzaldehyde-1,1'-diphenylhydrazone (DEH).

* * * * *